United States Patent [19]

Tachikawa et al.

[11] Patent Number: 4,909,862

[45] Date of Patent: Mar. 20, 1990

[54] PROCESS FOR ION NITRIDING ALUMINUM MATERIAL

[75] Inventors: Hideo Tachikawa; Tohru Arai; Hironori Fujita; Kazuyuki Oguri, all of Aichi, Japan

[73] Assignee: Kabushiki Kaisha Toyota Chuo Kenkyusho, Aichi, Japan

[21] Appl. No.: 365,856

[22] Filed: Jun. 13, 1989

[30] Foreign Application Priority Data

Jun. 17, 1988 [JP] Japan ..... 63-150451

[51] Int. Cl.[4] ..... C22F 1/02

[52] U.S. Cl. ..... 148/20.3; 204/177

[58] Field of Search ..... 148/16.6, 20.3; 204/177

[56] References Cited

U.S. PATENT DOCUMENTS 4,597,808 7/1986 Tachikawa et al. ..... 148/20.3

FOREIGN PATENT DOCUMENTS 62-202071 9/1987 Japan .

*Primary Examiner*—R. Dean

*Attorney, Agent, or Firm*—Berman, Aisenberg & Platt

[57] ABSTRACT

A process for ion nitriding aluminum material which comprises the steps of placing an object of aluminum or aluminum alloy for treatment in a closed vessel; evacuating residual oxygen gas from said closed vessel; charging said closed vessel with a heating gas and inducing discharges in said closed vessel, thereby heating the surface of the object for treatment to a prescribed nitriding temperature; charging said closed vessel with a surface-roughening gas composed of a rare gas and 5–2000 ppm of a gas containing at least one element of oxygen, nitrogen, and carbon, and roughening the surface of the object for treatment by means of glow discharges or ion beams in the atmosphere of said surface roughening gas; and charging said closed vessel with a nitriding gas and simultaneously inducing glow discharges in said closed vessel, thereby forming a nitride layer on the surface of the object for treatment.

10 Claims, 1 Drawing Sheet

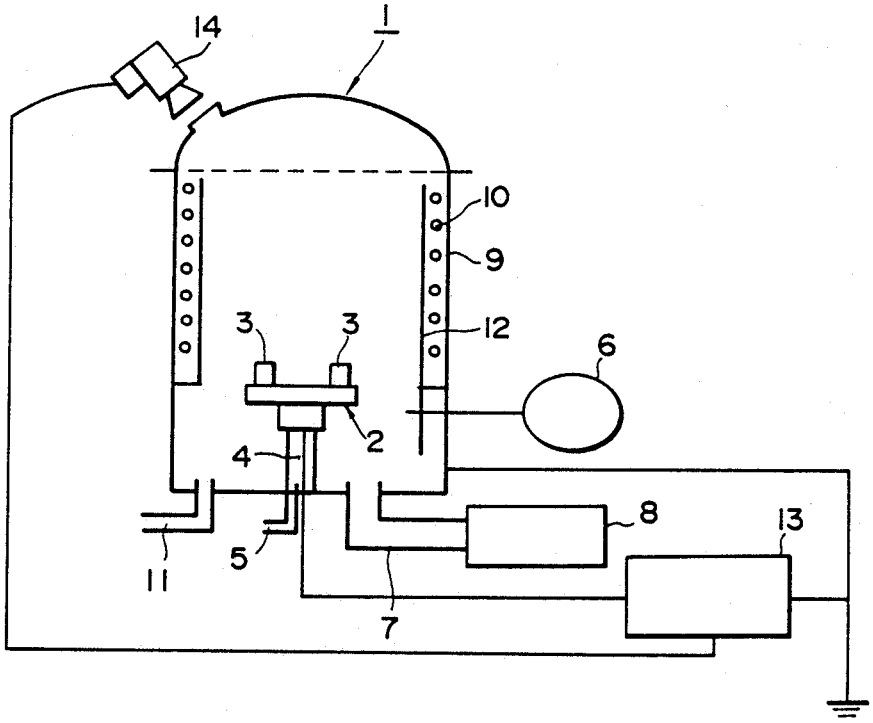
14
1
10
9
3
3
12
6
2
4
8
13
5
11
7

PROCESS FOR ION NITRIDING ALUMINUM MATERIAL

BACKGROUND OF THE INVENTION

1. Field of the Invention

The present invention relates to a process for ion nitriding aluminum and aluminum alloys.

2. Description of the Related Art

The technologies of surface treatment of aluminum and aluminum alloys (hereinafter referred to as aluminum material) have been developed to remedy the low hardness and poor wear resistance of aluminum material. One of the technologies is the formation of an aluminum nitride layer on the surface of aluminum material. Aluminum nitride has several superior characteristics: thermal stability at very high temperatures, high hardness (Hv 1000 and above), high wear resistance, high thermal conductivity, and good insulation properties.

There have been proposed several processes for forming an aluminum nitride layer. According to one process (disclosed in Japanese Patent Laid-open No. 25963/1981), nitriding is accomplished by heating part of an aluminum material (to be treated) above a melting point of aluminum, thereby causing aluminum to react with nitrogen. A disadvantage of this melting process is that the aluminum material to be treated deforms upon melting and the resulting surface layer is a mixture of aluminum nitridge (AlN) and aluminum (Al), which has a hardness lower than Hv 200. Alternative processes include reactive sputtering and vacuum deposition. These processes, however, only provide an aluminum nitride layer which is attached to the base layer by mechanical force or intermolecular force and hence is poor in adhesion to the base layer. Moreover, they are not suitable for mass treatment and are expensive.

Under the circumstances, the present inventors filed applications for patent on "Process for ion nitriding of aluminum or an aluminum alloy and aparatus therefor" (U.S. Pat. No. 4,522,660/1985), "Process for ion nitriding aluminum or aluminum alloys" (U.S. Pat. No. 4,597,808 and Japanese Patent Application Laid-Open No. 202071/1987). The first one is characterized by placing a metal having a strong affinity for oxygen near the object to be treated in the ion nitriding apparatus so that the metal removes oxygen (inhibitor of ion nitriding) which enters the apparatus, thereby helping the formation of a good nitride layer on the object. The second one is characterized by activating the surface of the object to be treated by introducing a gas for nitriding into the sealed vessel, allowing discharge in the vessel prior to ion nitriding so that a good aluminum nitride layer is formed on the object. The third one is characterized by roughening the surface of the object to be treated to a roughness of 0.1 $\mu$m and above (in terms of $R_2$) prior to ion nitriding so that a good aluminum nitride layer is formed easily on the object. These technologies were successful with the formation of a nitride layer having good wear resistance and good adhesion on the surface of an aluminum material.

Nevertheless, these prior art technologies still have disadvantages. In the first case, it is possible to remove oxygen entering the ion nitriding apparatus, but it is impossible to remove oxides formed on the object for treatment. It has another disadvantage that it takes a longer time or the resulting nitride layer easily peels off if the nitridge layer is thicker than usual. In the second and third cases, the surface activating or roughening with a rare gas (such as argon) takes a long time.

In order to solve the above-mentioned problems encountered in the prior art technologies, the present inventors carried out a series of researches, which led to the present invention.

SUMMARY OF THE INVENTION

Accordingly, it is an object of the present invention to provide a process for the surface treatment which rapidly and efficiently forms a nitride layer of good wear resistance and adhesion on the surface of aluminum material.

It is a further object of the present invention to provide a process for ion nitriding aluminum material which can be carried out even at low temperatures, such as the solution heat-treatment temperature or below.

In their research on the process of surface-roughening used in the prior art technology, the present inventors have found that surface-roughening can be accelerated when the surface of the object for treatment is partly changed into a compound which is different from aluminum in sputtering rate, or the compound is attached on this surface. The present invention is based on this finding.

Other objects, features, and advantages of the present invention will become apparent from the following description when taken in conjunction with the accompanying drawings.

BRIEF DESCRIPTION OF THE DRAWINGS

The single drawing is a schematic view showing the ion nitriding apparatus used in Examples 1 and 2 of the present invention.

DETAILED DESCRIPTION OF THE INVENTION

The present invention provides a process for ion nitriding aluminum material which comprises the steps of placing an object of aluminum or aluminum alloy for treatment in a closed vessel; evacuating residual oxygen gas from said closed vessel; charging said closed vessel with a heating gas and inducing discharges in said closed vessel, thereby heating the surface of the object for treatment to a prescribed nitriding temperature; charging said closed vessel with a surface-roughening gas composed of a rare gas and 5-2000 ppm of a gas containing at least one one of the elements: oxygen, nitrogen, and carbon, and roughening the surface of the object for treatment by means of glow discharges or ion beams in the atmosphere of said surface roughening gas; and charging said closed vessel with a nitriding gas and simultaneously inducing glow discharges in said closed vessel, thereby forming a nitride layer on the surface of the object for treatment.

The present invention constructed as mentioned above has the following functions and effects.

The process of the invention enables a great reduction of time required for surface-roughening.

The process of the invention enables efficient and rapid formation of a hard, highly wear-resistant nitride layer on the surface of an object of aluminum material.

The process of the invention forms a nitride layer which has good adhesion and uniformity.

The process of the present invention enables ion nitriding at a temperature below the solution heat-treatment temperature (about 550° C.) for aluminum material. Therefore, it enables ion nitriding without appreciable deformation of the object for treatment.

The process of the present invention enables ion nitriding even in the case where the object of aluminum material for treatment has an alumina film formed by bonding with oxygen.

No elucidation has been made of the mechanism by which the above-mentioned effects are produced; however, the folowing inference may be drawn. As mentioned above, the process of the present invention includes a surface roughening step by which a surface of the object for treatment is roughened in an atmosphere composed of a rare gas and 5-2000 ppm of a gas containing at least one of the elements: oxygen, nitrogen, and carbon. The ion bombardment induced by glow discharges in the atmosphere of such a mixed gas causes the oxygen or nitrogen in the mixed gas to oxidize or nitride the surface of the object for treatment or causes the carbon in the mixed gas to separate out on the surface of the object for treatment. These chemical reactions change part of the surface of the object for treatment and this change leads to the difference in sputtering rate and hence the efficient surface-roughening. The roughened surface permits a nitride layer to be formed in a short time. When the roughened surface undergoes ion nitriding, a nitride layer is formed faster in valleys than on peaks. As the ion nitriding proceeds, the roughened surface eventually becomes covered with a flat nitride layer, with an irregular interlayer formed between the nitride layer and the aluminum matrix. This interlayer contributes to the adhesion of the nitride layer.

The process of the present invention is carried out in the following manner. At first, the object of aluminum of aluminum alloy for treatment is disposed in a closed vessel by means of a holder or hanger. (Incidentally, the aluminum alloy is one which is composed of aluminum as a major component and one or more elements selected from chromium, copper, magnesium, manganese, silicon, nickel, iron, and zinc.) After sealing, the closed vessel is evacuated to remove residual oxygen by means of a vacuum pump (such as rotary pump and diffusion pump). Into the evacuated vessel is admitted a non-oxidizing gas (such as hydrogen, nitrogén, and rare gas) which is intended to protect the surface of the object for treatment from oxidation and to keep it at a constant temperature. At the same time, the object for treatment is heated to the nitriding temperature by discharging or with a heater provided in or around the vessel. The heating by discharging may be accomplished by DC glow discharge or high-frequency AC glow discharge. The former is preferable because of its low cost and high heating capacity. In addition, it has an advantage of heating the object for treatment with a minimum damage to it by ion bombardment and ionizing the gas in the vessel, causing accelerated particles to collide against the surface of the object for treatment, thereby cleaning it out of organic substances, such as carbon, oil and so on. During the heating step, the closed vessel should be kept at a pressure of $10^{-3}$ to 10 Torr. For DC glow discharge, the desired pressure is $10^{-2}$ to 10 Torr, and for AC glow discharge, the desired pressure is $10^{-3}$ to 10 Torr. Under pressures outside this range, the discharging will be unstable.

Then, the closed vessel is filled with a gas mixture composed of a rare gas and 5-2000 ppm of surface-roughening gas. The surface of the object for treatment is roughened by glow discharge or ion beam. The surface roughening step is intended to modify the surface of the object for treatment such that it permits aluminum nitride to be formed easily and rapidly on it. The surface-roughening gas is a gas containing at least one element of oxygen, nitrogen, and carbon. It includes, for example, oxygen ($O_2$), nitrogen ($N_2$), methane ($CH_4$), water vapor or steam ($H_2O$), carbon monoxide (CO), carbon dioxide ($CO_2$), nitrogen dioxide ($NO_2$), and methyl hydroxide ($CH_3OH$). The rare gas is one or more selected from helium (He), neon (Ne), argon (Ar), krypton (Kr), xenon (Xe), and radon (Rn).

The surface-roughening gas should contain the rare gas in an amount of 5 to 2000 ppm. With an amount less than 5 ppm, the surface-roughening is slow and hence the subsequent nitriding is also slow. With an amount more than 2000 ppm, the surface-roughening is slow and contaminates the surface of the object for treatment, thereby interfering with the subsequent nitriding reaction. The surface-roughening gas should preferably keep its composition constant during the surface-roughening step; however, the concentration of the rare gas may vary in the range of 5 to 2000 ppm. The adequate concentration of the rare gas should be properly selected according to the total gas pressure and discharge voltage and their fluctuation. The above-mentioned gas mixture enables effective surface roughening.

The surface-roughening is usually accomplished by DC glow discharge or AC glow discharge; however, it may also be accomplished by ion beam sputtering. The DC glow discharge is preferable because of its low cost and good cleaning effect and heating ability. The surface-roughening should preferably be carried out at $10^{-3}$ to 5 Torr in the closed vessel. The preferred pressure is $10^{-2}$ to 5 Torr for DC glow discharge and $10^{-3}$ and 1 Torr for AC glow discharge. Under a pressure outside this range, the glow discharge does not perform the surface-roughening effectively.

Switching from the heating step to the surface-roughening step may be achieved by switching the heating gas to the surface-roughening gas while continuing the discharging. Alternatively, it may be achieved by suspending the supply of the heating gas and the discharging at the same time, removing the heating gas, admitting the surface-roughening gas up to a prescribed pressure, and resuming the discharging. If necessary, the surface-roughening may be accompanied by heating. Since the surface-roughening step is a pretreatment for the ion nitriding step (mentioned later), it may be carried out prior to the above-mentioned heating step. Incidentally, the surface-roughening may be carried out at an ambient temperature lower than the solution heat-treatment temperature (about 550° C.) for aluminum material. Therefore, the surface-roughening gas should preferably be in a gaseous state at temperatures lower than that.

The closed vessel is evacuated of the surface-roughening gas and then charged with a nitriding gas. The object for treatment is subjected to ion nitriding by glow discharge in the closed vessel. The gas for ion nitriding is nitrogen ($N_2$), ammonia ($NH_3$), or a mixture gas of nitrogen ($N_2$) and hydrogen ($H_2$). A high nitrogen-content gas is preferable. High-purity nitrogen forms aluminum nitride rapidly, without corroding the closed vessel. The ion nitriding is accomplished by the aid of DC or AC glow discharge. The ion nitriding should be carried out at a pressure of $10^{-1}$ to 20 Torr in the closed vessel. With a pressure lower than this range, the nitriding (or the formation of an aluminum nitride layer) is slow; and with a pressure higher than this range, the discharging is unstable due to the occurrence of arcs. The ion nitriding step should be carried ou at 300°-550° C. With a temperature lower than 300° C., the nitriding is slow; and with a temperature higher than 550° C., the object for treatment might melt, resulting in dimensional change and strain, which in turn causes the aluminum nitride layer to peel off easily in the subsequent cooling step. The preferred temperature is 400°-520° C.

DESCRIPTION OF THE PREFERRED EMBODIMENTS

The invention will be described in more detail with reference to the following examples.

EXAMPLE 1

An object of aluminum material was subjected to ion nitriding to form an aluminum nitride layer thereon, and it was tested for performance. The ion nitriding was performed by operating an ion nitriding apparatus shown in the fig. in the following manner.

Two objects for treatment were placed on the holder 2 installed at the center of the stainless steel closed vessel 1. The object (designated as Sample No. 1) is a cylindrical block measuring 20 mm in outside diameter and 10 mm thick, made of industrial pure aluminum (JIS 1050, having a purity higher than 99.5%). Incidentally, the holder 2 is supported by a pedestal 4 in which is enclosed a cooling water pipe 5, and the closed vessel is provided with a mercury manometer 6.

The closed vessel 1 was evacuated to $10^{-5}$ Torr by means of a vacuum pump 8 (composed of an unshown rotary pump and diffusion pump) through a gas discharging pipe 7 connected to the bottom of the closed vessel 1. Incidentally, the closed vessel 1 is connected to unshown gas cylinders of high-purity nitrogen, high-purity argon, high-purity hydrogen, and argon containing prescribed amounts of oxygen, nitrogen, and methane through a gas introducing pipe 11 connected to the bottom of the closed vessel 1.

After having been evacuated down to $10^{-5}$ Torr, the closed vessel was continuously charged with hydrogen (as the heating gas). The pressure in the closed vessel was kept at 1.3 Torr by the application of a controlled vacuum. The sample was subjected to ion bombardment until its surface reached 500° C. by discharges induced by the application of a DC voltage (several hundred volts) across a stainless steel anode 12 (inside the preheater 10) and a cathode (the holder 2). The DC power is supplied from a power source 13 which is controlled by the signals from a two-color pyrometer 14 to measure the temperature of the sample in the closed vessel. In this way, the sample is kept at a constant temperature.

The supply of hydrogen was suspended, and the closed vessel was charged with a surface-roughening gas at 0.6 Torr. The surface-roughening gas is a mixture gas composed of argon and a prescribed amount of additive gas as shown in Table 1. With the pressure in the closed vessel kep at 0.6 Torr, the sample was subjected to glow discharge at 500° C. for 20 minutes to effect surface-roughening.

The surface-roughening gas was switching to nitrogen (as the nitriding gas). With the pressure in the closed vessel kept at 2 Torr, the sample was subjected to ion nitriding by glow discharge at 500° C. for 5 hours.

After the ion nitriding was completed, glow discharging was suspended and the sample was cooled under reduced pressure in the closed vessel. It was found that a black layer was formed on the surface of the sample.

The black layer on the surface of the sample was identified as aluminum nitride (AlN) of wurtzite type by X-ray diffractometry. The black layer on each sample was found to have a thickness shown in Table 1.

For the purpose of comparison, the same procedure as mentioned above was repeated, except that the surface-roughening gas was replaced by pure argon gas (Sample No. C1) or the surface-roughening gas was replaced by one which contains the additive gas in concentrations outside the range specified in this invention (Sample Nos. C2-C7). It was fond that a blackish thin layer was formed on the surface of the sample. It was identified as aluminum nitride (AlN) of wurtzite type by X-ray diffractometry, and was also found to have a thickness as shown in Table 2.

It is noted from Tables 1 and 2 that a nitride layer thicker than 1 μm was formed on all the samples (Nos. 1-15) in the case where surface-roughening was performed at 500° C. for 20 minutes with a surface-roughening gas containing the additive gas in an amount of 5 to 1900 ppm according to the present invention. It is also noted that a thick nitride layer was formed when the additive gas was used in a specified amount. That is, the thickness is greater than 4 μm when the additive gas was nitrogen in an amount of 55-600 ppm; the thickness was greater than 3 μm when the additive gas was oxygen in an amount of 25-500 ppm; and the thickness was greater than 3 μm when the additive gas was methane in an amount of 65-710 ppm. The maximum thickness was obtained when the concentration of the additive gas was several hundred ppm.

By contrast, the nitride layer was thinner than 0.1 μm in the comparative sample No. C1 (treated with pure argon gas as the surface-roughening gas) and in the comparative sample Nos. C2-C7 (treated with the surface-roughening gas containing the additive gas in an amount not conforming to the present invention). Incidentally, in the case of the comparative sample No. C1, a nitride layer thicker than about 5 μm was obtained when the duration of the surface-roughening was extended to 60 minutes. In the case of sample No. C5 in which the concentration of the additive gas is higher than specified in the present invention, the nitride layer was thinner than 0.1 μm even when the surface-roughening was continued for about 60 minutes. The reason for this is probably the decreased surface-roughening as well as the excessive surface oxidation that inhibits the nitriding reaction.

The results in this example indicate that the preferred concentration of the additive gas is in the range of 50 to 500 ppm for the accelerated surface-roughening with a minimum of surface contamination. The concentration of the additive gas should be properly controlled so that the resulting nitride layer has a maximum thickness, because a thick nitride layer is desirable when the treated object is used as a wear-resistant part.

TABLE 1

| | Surface roughening gas | | Results |
|---|---|---|---|
| Sample No. | Additive gas | Concentration of additive gas (ppm) | Thickness of nitride layer (μm) |
| 1 | $N_2$ | 5 | 1.0 |
| 2 | $N_2$ | 55 | 4.2 |

TABLE 1-continued

| Sample No. | Surface roughening gas: Additive gas | Surface roughening gas: Concentration of additive gas (ppm) | Results: Thickness of nitride layer (μm) |
|---|---|---|---|
| 3 | $N_2$ | 305 | 6.0 |
| 4 | $N_2$ | 600 | 4.5 |
| 5 | $N_2$ | 1900 | 1.1 |
| 6 | $O_2$ | 5 | 1.2 |
| 7 | $O_2$ | 25 | 3.0 |
| 8 | $O_2$ | 210 | 5.0 |
| 9 | $O_2$ | 500 | 3.2 |
| 10 | $O_2$ | 1800 | 1.0 |
| 11 | $CH_4$ | 5 | 1.0 |
| 12 | $CH_4$ | 65 | 3.0 |
| 13 | $CH_4$ | 206 | 2.5 |
| 14 | $CH_4$ | 710 | 3.1 |
| 15 | $CH_4$ | 1850 | 1.1 |

TABLE 2

| Sample No. | Surface roughening gas: Additive gas | Surface roughening gas: Concentration of additive gas (ppm) | Results: Thickness of nitride layer (μm) |
|---|---|---|---|
| C1 | — | — | less than 1.0 |
| C2 | $N_2$ | 1 | 0.1 |
| C3 | $N_2$ | 7050 | less than 0.1 |
| C4 | $O_2$ | 1 | 0.1 |
| C5 | $O_2$ | 6600 | less than 0.1 |
| C6 | $CH_4$ | 1 | 0.1 |
| C7 | $CH_4$ | 7060 | 0.1 |

EXAMPLE 2

The same procedure as in Example 1 was repeated except the following. The surface-roughening gas was replaced by one which is composed of argon and 50 ppm each of oxygen and nitrogen as additive gases. The closed vessel was charged with this surface-roughening gas at 0.7 Torr. The sample was subjected to surface-roughening under this pressure by glow discharge at 500° C. for 20 minutes. The sample was subsequently subjected to nitriding with high-purity nitrogen gas by glow discharge under 2 Torr at 525° C. for 2 hours.

Thus, a black layer was formed on the surface of the sample. It was identified as aluminum nitride of wurtzite type by X-ray diffractometry, and was also found to have a thickness of 5 μm. The treated sample was found to have a surface hardness of Hv 1000 kg/mm$^3$.

The result of this example indicates that a mixed additive gas of oxygen and nitrogen also performs the surface-roughening in a short time which enables the formation of an aluminum nitride layer on the sample.

What is claimed is:

1. A process for ion nitriding aluminum material which comprises the steps of placing an object of aluminum or aluminum alloy for treatment in a closed vessel; evacuating residual oxygen gas from said closed vessel; charging said closed vessel with a heating gas and inducing discharges in said closed vessel, thereby heating the surface of the object for treatment to a prescribed nitriding temperature; charging said closed vessel with a surface-roughening gas composed of a rare gas and 5–2000 ppm of a gas containing at least one element selected from the group consisting of oxygen, nitrogen, and carbon, and roughening the surface of the object for treatment by means of glow discharges or ion beams in the atmosphere of said surface-roughening gas; and charging said closed vessel with a nitriding gas and simultaneously inducing glow discharges in said closed vessel, thereby forming a nitride layer on the surface of the object for treatment.

2. A process for ion nitriding aluminum material as claimed in claim 1, wherein the nitriding gas used in the ion nitriding step is nitrogen gas, ammonia gas, or a mixture thereof with hydrogen gas and rare gas.

3. A process for ion nitriding aluminum material as claimed in claim 1, wherein the ion nitriding step is performed at 300° C. to 550° C.

4. A process for ion nitriding aluminum material as claimed in claim 1, wherein the surface-roughening gas is composed of a rare gas and at least one gas selected from the group consisting of oxygen, nitrogen, methane, hydrogen oxide, carbon monoxide, carbon dioxide, nitrogen dioxide and methyl hydroxide.

5. A process for ion nitriding aluminum material as claimed in claim 1, wherein the concentration of said gas containing at least one element of oxygen, nitrogen and carbon in an atmosphere of said closed vessel is in the range of 20 to 800 ppm.

6. A process for ion nitriding aluminum material as claimed in claim 5, wherein the nitriding gas used in the ion nitriding step is nitrogen gas, ammonia gas, or a mixture thereof with hydrogen gas and rare gas, and the ion nitriding step is performed at 300° C. to 550° C.

7. A process for ion nitriding aluminum material as claimed in claim 6, wherein the closed vessel is filled with a gas mixture composed of argon gas and 50–650 ppm of nitrogen gas in the surface-roughening step.

8. A process for ion nitriding aluminum material as claimed in claim 6, wherein the closed vessel is filled with a gas mixture composed of argon gas and 25–500 ppm of oxygen gas in the surface-roughening step.

9. A process for ion nitriding aluminum material as claimed in claim 6, wherein the closed vessel is filled with a gas mixture composed of argon gas and 50–750 ppm of methane gas in the surface-roughening step.

10. A process for ion nitriding aluminum material as claimed in claim 6, wherein the closed vessel is filled with a gas mixture composed of argon gas, nitrogen gas and oxygen gas in the surface-roughening step.

* * * * *